US008205596B2

(12) United States Patent
Kieferle et al.

(10) Patent No.: US 8,205,596 B2
(45) Date of Patent: Jun. 26, 2012

(54) FUEL INJECTION DEVICE FOR AN INTERNAL COMBUSTION ENGINE

(75) Inventors: Stefan Kieferle, Stuttgart (DE); Dorothee Sommer, Stuttgart (DE); Oliver Becker, Ludwigsburg (DE); Bjoern Noack, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 519 days.

(21) Appl. No.: 12/304,915

(22) PCT Filed: Apr. 25, 2007

(86) PCT No.: PCT/EP2007/054067

§ 371 (c)(1),
(2), (4) Date: Sep. 14, 2009

(87) PCT Pub. No.: WO2007/144227

PCT Pub. Date: Dec. 21, 2007

(65) Prior Publication Data

US 2010/0012096 A1 Jan. 21, 2010

(30) Foreign Application Priority Data

Jun. 14, 2006 (DE) ..... 10 2006 027 486

(51) Int. Cl.
*F02M 57/02* (2006.01)
*F02M 37/04* (2006.01)

(52) U.S. Cl. ..... 123/446; 123/497

(58) Field of Classification Search ..... 123/446, 123/447, 497

See application file for complete search history.

(56) References Cited

U.S. PATENT DOCUMENTS 4,174,694 A * 11/1979 Wessel et al. ..... 123/357
4,404,944 A * 9/1983 Yamazaki et al. ..... 123/458

(Continued)

FOREIGN PATENT DOCUMENTS

DE 10056048 A1 6/2002

(Continued)

*Primary Examiner* — Thomas Moulis
(74) *Attorney, Agent, or Firm* — Ronald E. Greigg

(57) ABSTRACT

The fuel injection device for an internal combustion engine comprises a feed pump which has an electric drive, by which feed pump fuel is fed from a fuel storage tank into a low-pressure region to the suction side of at least one high-pressure pump. The high-pressure pump pumps fuel into a high-pressure region in which at least one injector is provided to inject the fuel into the internal combustion engine. The fuel injection is controlled by an electric control device. Arranged in the low-pressure region is a pressure sensor which is connected to the control device. The electric drive of the feed pump is activated by the control device in order to set a feed quantity of the feed pump which is variable as a function of at least one operating parameter of the internal combustion engine and/or of the high-pressure pump. The drive of the feed pump is in particular activated by the control device in such a way that, at a high load of the internal combustion engine and/or at a high rotational speed and/or at a high fuel temperature, a greater fuel quantity is fed by the feed pump into the low-pressure region than at a low load and/or a low rotational speed and/or a low fuel temperature.

18 Claims, 2 Drawing Sheets

U.S. PATENT DOCUMENTS

| | | | | |
|---|---|---|---|---|
| 5,542,395 | A * | 8/1996 | Tuckey et al. | 123/497 |
| 6,135,090 | A * | 10/2000 | Kawachi et al. | 123/446 |
| 6,450,148 | B2 * | 9/2002 | Nakamura et al. | 123/464 |
| 6,457,460 | B1 * | 10/2002 | Doane et al. | 123/541 |
| 6,609,500 | B2 * | 8/2003 | Ricco et al. | 123/446 |
| 6,889,656 | B1 * | 5/2005 | Rembold et al. | 123/446 |
| 7,082,928 | B2 * | 8/2006 | Fritsch et al. | 123/478 |
| 7,343,901 | B2 * | 3/2008 | Mori et al. | 123/446 |
| 7,493,893 | B2 * | 2/2009 | Funabashi et al. | 123/497 |
| 7,634,985 | B2 * | 12/2009 | Parker et al. | 123/435 |
| 7,891,338 | B2 * | 2/2011 | Ricco et al. | 123/446 |
| 7,980,223 | B2 * | 7/2011 | Ricco et al. | 123/446 |
| 2002/0088437 | A1 * | 7/2002 | Ricco et al. | 123/457 |
| 2003/0111050 | A1 * | 6/2003 | Schueler | 123/446 |
| 2006/0225706 | A1 * | 10/2006 | Eser et al. | 123/457 |

FOREIGN PATENT DOCUMENTS

| | | | |
|---|---|---|---|
| DE | 10223077 | A1 | 12/2003 |
| DE | 10343482 | A1 | 4/2005 |
| EP | 1195514 | A2 | 4/2002 |
| EP | 1342912 | A2 | 9/2003 |
| WO | 02055873 | A1 | 7/2002 |

* cited by examiner

FUEL INJECTION DEVICE FOR AN INTERNAL COMBUSTION ENGINE

CROSS-REFERENCE TO RELATED APPLICATION

This application is a 35 USC 371 application of PCT/EP 2007/054067 filed on Apr. 25, 2007.

BACKGROUND OF THE INVENTION

1. Field of the Invention

The invention is based on a fuel injection device for an internal combustion.

2. Description of the Prior Art

A fuel injection device of this kind is known from DE 103 43 482 A1. This fuel injection device has a delivery pump, which is equipped with an electric drive unit and delivers fuel from a fuel tank to the intake side of a high-pressure pump. The high-pressure pump delivers fuel into a high-pressure region; in the high-pressure region, at least one injector is provided, which is situated on the internal combustion engine and injects fuel into the engine. The fuel injection device also has an electronic control unit that controls the fuel injection as a function of operating parameters of the internal combustion engine. Between the delivery pump and the intake side of the high-pressure pump, a fuel metering device is provided, which is triggered by the electronic control unit and is able to vary the fuel supply to the intake side of the high-pressure pump and therefore the fuel quantity that the high-pressure pump delivers into the high-pressure region. In the high-pressure region, a pressure sensor is provided, which is connected to the electronic control unit and detects the pressure in the high-pressure region; the control unit triggers the fuel metering device so that the high-pressure pump supplies the high-pressure region with the fuel quantity that is required to maintain a predetermined pressure in the high-pressure region. The delivery pump is operated at an essentially constant speed so that it delivers an essentially constant fuel quantity that must be dimensioned so that the maximum fuel demand of the internal combustion engine is made available. As a result, the delivery quantity of the delivery pump is too large in most operating states of the engine other than full load. The excess fuel quantity of the fuel pump is diverted into a pressure-relief region by an overflow valve situated between the delivery pump and the fuel metering device. The delivery pump in this case must be very large and must be dimensioned for a corresponding long-term load, which results in high manufacturing costs and a high electrical power demand for its operation.

ADVANTAGES AND SUMMARY OF THE INVENTION

The fuel injection device according to the invention, with the defining characteristics recited in claim 1, has the advantage over the prior art that the delivery pump is operated in a demand-controlled fashion making it possible, in terms of its dimensioning, for it to be designed for a lower average long-term load and the electric power demand for its drive unit to be significantly lower, averaged out over all operating states of the internal combustion engine. In this case, the operation of the delivery pump can be optimized, for example, to improve the operating conditions of the high-pressure pump.

Advantageous embodiments and modifications of the fuel injection device according to the invention are disclosed in additional to the above. The invention has the advantage that a possible pressure drop during the passage through the fuel filter has no influence on the pressure detection in the low-pressure region. The invention further has the advantage of an improvement in the lubrication and/or cooling of the drive region of the high-pressure pump under a high load. The invention further has the advantage of an improvement in the lubrication and/or cooling of the drive region of the high-pressure pump at high fuel temperatures. The invention further has the advantage that fuel delivered by the delivery pump that is not taken in by the high-pressure pump can be diverted out of the low-pressure region. The invention further has the advantage that the total fuel quantity delivered by the delivery pump is available for lubrication and/or cooling of the drive region of the high-pressure pump.

BRIEF DESCRIPTION OF THE DRAWINGS

Exemplary embodiments of the invention are shown in the drawings and described in further detail in the ensuing description, in which.

DESCRIPTION OF THE PREFERRED EMBODIMENTS

Figure 1:
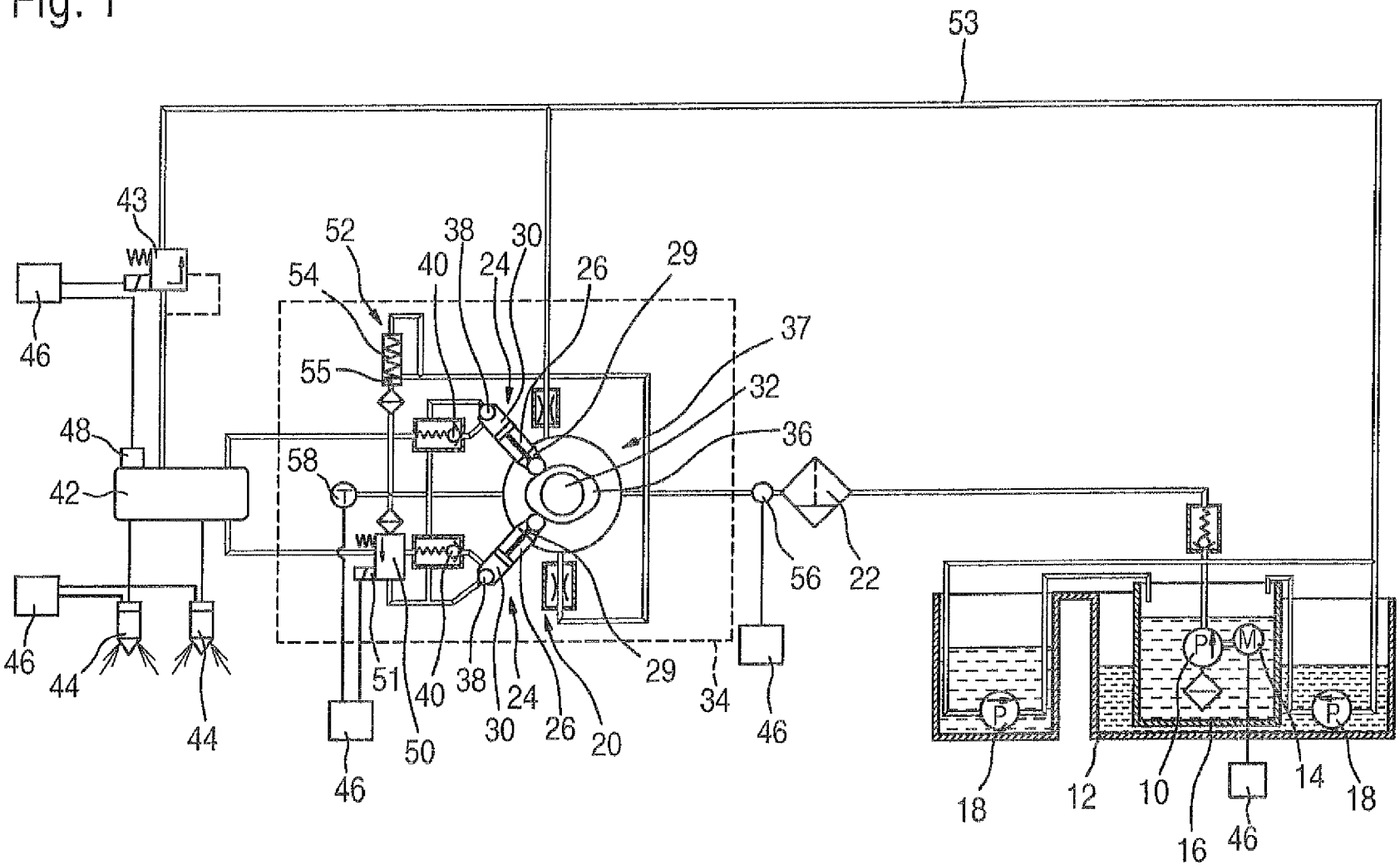
FIG. 1 is a schematic depiction of a fuel injection device for an internal combustion engine according to a first exemplary embodiment.
Figure 3:
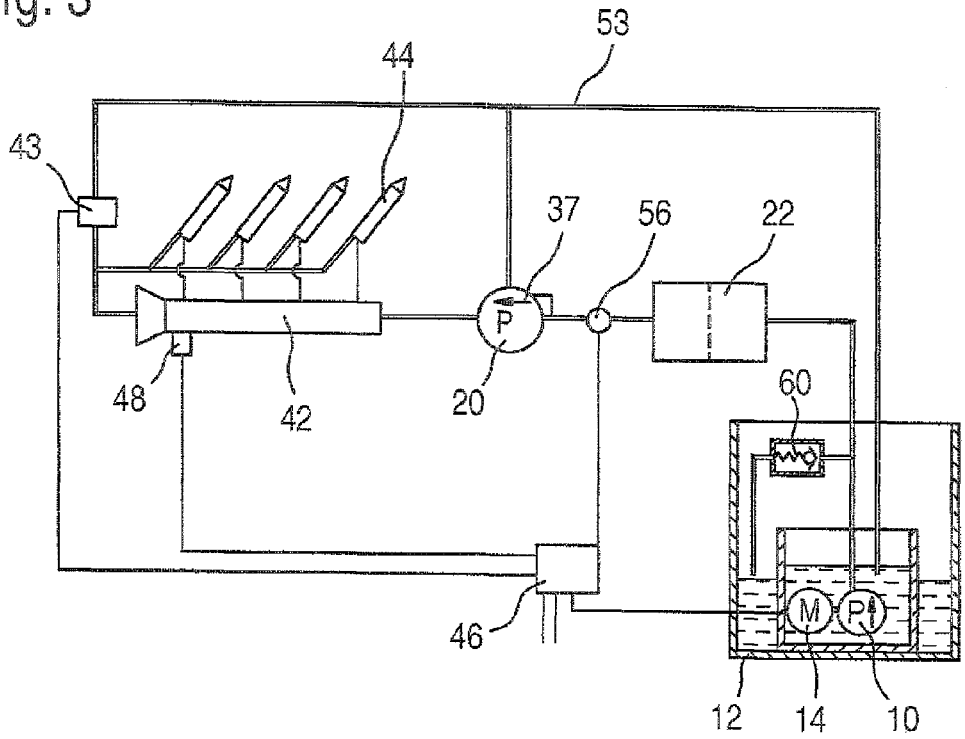
FIG. 3 is a schematic depiction of the fuel injection device according to a second exemplary embodiment.

FIGS. 1 and 3 schematically depict a fuel injection device for an internal combustion engine, for example of a motor vehicle. The fuel injection device has a delivery pump 10 that draws fuel from a fuel tank 12. The delivery pump 10 has an electric drive unit 14 in the form of an electric motor and the delivery pump 10 can be situated outside the fuel tank 12 or, as depicted in FIGS. 1 and 3, inside the fuel tank 12. Inside the fuel tank 12, a fuel collecting cup or swirl pot 16 can be provided, from which the delivery pump 10 draws fuel and which assures that the delivery pump 10 is able to draw fuel even when the fuel level in the fuel tank 12 is low. For example, fuel is delivered into the swirling pot 16 by means of at least one jet pump 18. The delivery pump 10 delivers fuel to the intake side of a high-pressure pump 20 of the fuel injection device. Between the delivery pump 10 and the intake side of the high-pressure pump 20, a fuel filter 22 is provided, which purifies the fuel delivered by the delivery pump 10 before it flows to the high-pressure pump 20.

The high-pressure pump 20 has one or more pump elements 24, each of which is equipped with a respective pump piston 28 guided in a cylinder bore 26. Each pump piston 28 delimits a pump working chamber 30 in the respective cylinder bore 26. The respective pump pistons 28 are each set into a stroke motion at least indirectly by a drive shaft 32 that is driven to rotate by the internal combustion engine. The drive shaft 32 is supported in rotary fashion for example by means of two bearing points situated spaced apart from each other in the direction of the rotation axis of the drive shaft 32 in a housing 34 of the high-pressure pump 14. The bearing points can be situated in various parts of the pump housing 34; for example a first bearing point can be situated in a base body of the pump housing 34 and a second bearing point can be situated in a flange component attached to the base body. In a region situated between the two bearing points, the drive shaft 32 has at least one cam 36 or a section situated eccentric to its rotation axis; the cam 36 can also be embodied in the form of a multilobe cam. The drive shaft 32 of the high-pressure pump 20 is driven by the internal combustion engine, for example by means of its crankshaft or camshaft. The drive shaft 32 can be coupled to the engine, for example, by means of a belt (toothed belt), a chain, or gears. Because the high-pressure pump 20 is driven by the engine, the speed of the drive shaft 32 of the high-pressure pump 20 is proportional to the speed of the engine.

Each of the pump pistons 28 can rest against the cam 36 or eccentric of the drive shaft 32 directly or indirectly by means of a tappet 29. Each pump element 24 has an inlet valve 38, which opens into the pump working chamber 30 and via which the pump working chamber 30 is filled with fuel during the intake stroke of the pump piston 28 oriented radially inward toward the drive shaft 32. Each pump element 24 also has an outlet valve 40, which opens out from the pump working chamber 30 and via which the compressed fuel is displaced from the pump working chamber 30 during the delivery stroke of the pump piston 28 oriented radially outward. The inlet valve 38 and the outlet valve 40 are each embodied as a spring-loaded check valve. The drive shaft 32 with the cam 36 or eccentric and the support of the at least one pump piston 28 constitute a drive region 37 of the high-pressure pump 20 situated inside the pump housing 34.

The high-pressure pump 14 delivers fuel via at least one line into a high-pressure region in which a reservoir 42, for example, is situated. The reservoir 42 is connected to at least one injector 44, which is mounted on a cylinder of the engine and injects fuel into the combustion chamber of the cylinder. It is also possible for the injectors 44 to be connected to the high-pressure pump 14 directly or indirectly via hydraulic lines 14, which makes it possible to eliminate the separate reservoir 42. The injector 44 has a fuel injection valve and, for example, an electrically actuated control valve that controls the opening and closing function of the fuel injection valve. It is also possible for the fuel injection valve to be directly controlled by means of an electrical actuator, for example a piezoelectric actuator.

The fuel injection device also has an electronic control unit 46 that controls the fuel injection. The control unit 46 triggers the injector 44 so that it injects a predetermined fuel quantity at a predetermined time. In the high-pressure region, a pressure sensor 48 is provided, which detects the pressure in the high-pressure region and is connected to the control unit 46. It is possible for a connection from the reservoir 42 to a pressure-relief region, e.g. a return to the fuel tank 12, to be provided, which is controlled by a pressure relief valve or pressure control valve 43.

In the first exemplary embodiment shown in FIG. 1, between the delivery pump 10 and the intake side of the high-pressure pump 20, a fuel metering device 50 is provided that is preferably situated between the fuel filter 22 and the intake side of the high-pressure pump 20. The region between the delivery pump 10 and the intake side of the high-pressure pump 20 is referred to below as the low-pressure region. The fuel metering device 50 can be embodied so that it continuously or discretely adjusts a different-sized flow cross section in the connection between the delivery pump 10 and the intake side of the high-pressure pump 20. Alternatively, the fuel metering device 50 can also be constituted by a cyclically operated valve that is opened and closed with a particular frequency; this valve opens a certain average flow cross section in accordance with its opening duration. The fuel metering device 50 can have an electric actuator 51 that can, for example, be embodied in the form of an electromagnet or a piezoelectric actuator, and is triggered by the control unit 46. Alternatively, the fuel metering device 50 can also be hydraulically controlled. In this connection, the flow cross section is determined by a piston that can be moved as it is acted on by a hydraulic pressure. The hydraulic pressure can, for example, be produced by the discharge of the pressure control valve 43. In this case, an increase in the discharge quantity of the pressure control valve 43 yields a higher pressure that reduces the flow cross section opened by the fuel metering device 50. The pressure control valve 43 can be triggered by means of the control unit 46 so that the control unit 46 controls the fuel metering device 50 indirectly by means of the discharge quantity of the pressure control valve 43.

Between the delivery pump 10 and the fuel metering device 50, the fuel injection device is also equipped with an overflow valve 52 that controls a connection of the low-pressure region to a pressure-relief region. In this case, the pressure-relief region is embodied, for example, in the form of a return 53 leading to the fuel tank 12; a lower pressure prevails in the pressure-relief region than in the low-pressure region. The overflow valve 52 is embodied in the form of a pressure valve that opens when a predetermined pressure is reached in the low-pressure region, permitting fuel to flow out of the low-pressure region into the pressure-relief region. The opening pressure of the overflow valve 52 is determined by a spring 54 that acts on a valve closure member 55 of the overflow valve 52 in a closing direction.

In the first exemplary embodiment shown in FIG. 1, the connection between the delivery pump 10 and the intake side of the high-pressure pump 20 leads through the drive region 37 of the high-pressure pump 20 in which are situated the drive shaft 32 with its bearing points and the eccentric or cam 36 with the support of the at least one pump piston 28 or tappet 29. The overflow valve 52 is situated downstream of the drive region 37, between this region and the fuel metering device 50. Consequently, the entire fuel quantity delivered by the delivery pump 10 first flows through the drive region of the high-pressure pump 20 before being drawn in by the high-pressure pump 20. Alternatively, it is also possible for a connection into the drive region of the high-pressure pump 20 to lead from the connection leading from the delivery pump 10, upstream of the fuel metering device 50. In this case, however, only the part of the fuel quantity delivered by the delivery pump 10 that is not conveyed to the intake side of the high-pressure pump 20 through the fuel metering device 50 is available for the lubrication of the drive region of the high-pressure pump 20.

The pressure prevailing in the low-pressure region between the fuel filter 22 and the intake side of the high-pressure pump 20 is detected by a pressure sensor 56 that is connected to the control unit 46. Preferably, the pressure sensor 56 is situated in the low-pressure region between the fuel filter 22 and the drive region of the high-pressure pump 20 so that a possible pressure drop in the flow through the fuel filter 22 is taken into account in the pressure detection in the low-pressure region. According to the invention, the control unit 46 triggers the electric drive unit 14 of the delivery pump 10 as a function of at least one operating parameter of the internal combustion engine and/or of the high-pressure pump 20 in order to adjust a variable fuel quantity of the delivery pump 10 and therefore a variable pressure in the low-pressure region between the delivery pump 10 and the intake side of the high-pressure pump 20.

One particular operating parameter that is taken into account in this case is the delivery quantity of the high-pressure pump 20, which corresponds to the load of the engine. The higher the load of the engine is, the greater the delivery quantity of the high-pressure pump 20 must be in order to maintain a predetermined pressure in the reservoir 42 since more fuel is drawn from the reservoir 42 by the injectors 44 and injected into the engine. As another operating parameter, it is possible to take into account the speed of the engine, which is proportional to the speed of the high-pressure pump 20. As an additional operating parameter, it is possible to take into account the fuel temperature that is detected by means of a fuel temperature sensor 58 that is connected to the control unit 46.

The control unit 46 triggers the drive unit 14 of the delivery pump 10 so that with a higher load and therefore a greater delivery quantity of the high-pressure pump 20 and/or with a higher speed of the engine and the high-pressure pump 20, the delivery pump 10 delivers a larger quantity of fuel into the low-pressure region and therefore a higher pressure is produced than with a low load and delivery quantity and/or low speed. In this case, with an increasing load of the engine and therefore with an increasing delivery quantity of the high-pressure pump 20, it is possible for the control unit 46 to trigger the electric drive unit 14 of the delivery pump 10 so that the delivery pump 10 delivers an ever greater quantity of fuel and as a result, an ever greater pressure is produced in the low-pressure region. The fuel quantity delivered by the delivery pump 10, which is not drawn in by the high-pressure pump 10 and is delivered into the reservoir 42, is diverted into the pressure-relief region 53 by the overflow valve 52. In this case, it is possible for the control unit 46 to increase the fuel quantity delivered by the fuel pump 10 disproportionately in relation to the fuel quantity to be delivered by the high-pressure pump 20 in order to assure a sufficient lubrication and/or cooling of the drive region 37 of the high-pressure pump 20. The excess fuel quantity delivered by the delivery pump 10 is diverted from the low-pressure region by means of the overflow valve 52.

Alternatively or in addition, it is possible for the control unit 46 to trigger the drive unit 14 of the delivery pump 10 so that with a high fuel temperature, the delivery pump 10 delivers a greater fuel quantity and as a result, a higher pressure is produced in the low-pressure region than with a low fuel temperature. In this case, it is possible that with an increasing fuel temperature, the control unit 46 triggers the drive unit 14 of the delivery pump 10 so that the delivery pump 10 delivers an increasing fuel quantity into the low-pressure region and as a result, a higher pressure is produced in the low-pressure region. This likewise assures a sufficient lubrication and/or cooling of the drive region 37 of the high-pressure pump 20 since the lubricating action of the fuel decreases as the fuel temperature rises.

Figure 2:
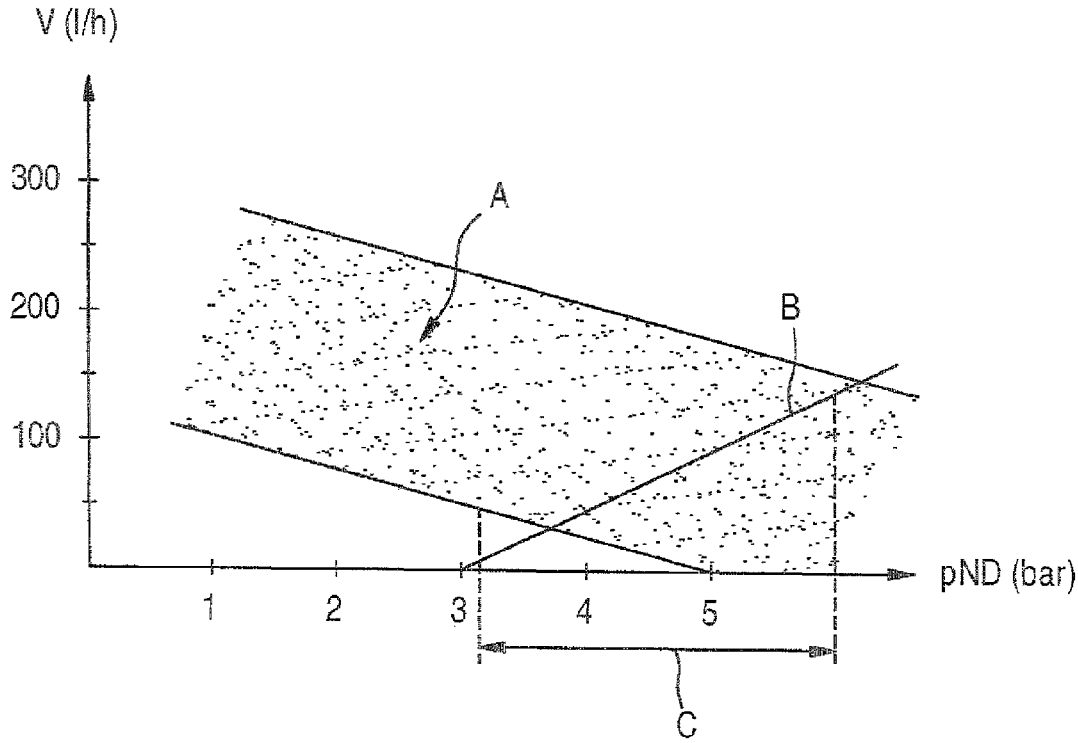
FIG. 2 is a graph in which the delivery quantity of a delivery pump and the overflow quantity of an overflow valve are plotted over the pressure prevailing in a low-pressure region.

Preferably, set point values for the pressure in the low-pressure region are stored in a characteristic map in the control unit 46; the control unit 46 then triggers the electric drive unit 14 of the delivery pump 10 so that the delivery pump 11 supplies the low-pressure region with the fuel quantity required to establish the set point value of the pressure. The characteristic of the overflow valve 52 is determined so that as the pressure in the low-pressure region increases, the overflow valve 52 diverts an increasing quantity of fuel into the pressure-relief region. The overflow valve 52 can, for example, have an at least approximately linear characteristic curve so that the fuel quantity diverted by means of the overflow valve 52 increases in proportion to the pressure in the low-pressure region. FIG. 2 shows a graph depicting, by way of example, the region A is in which the fuel quantity V delivered by the delivery pump 10 is plotted over the pressure pND prevailing in the low-pressure region. Also by way of example, the graph in FIG. 2 shows the characteristic curve B of the overflow valve 52, i.e. the fuel quantity V diverted by means of this valve as a function of the pressure pND prevailing in the low-pressure region. The working region of the overflow valve 52, i.e. the pressure region in which the overflow valve 52 diverts fuel from the low-pressure region, is labeled C in FIG. 3.

The overflow valve 52 is designed so that it is able to divert fuel—which is delivered by the delivery pump 10—from the low-pressure region, independent of the setting of the fuel metering device 50. The overflow valve 52 thus permits a variable setting of the pressure in the low-pressure region and therefore of the delivery quantity of the delivery pump 10, independent of the fuel quantity to be delivered by the high-pressure pump 20. This makes it possible to improve the lubrication and/or cooling of the drive region of the high-pressure pump 20 as needed, independent of the fuel quantity to be delivered by the high-pressure pump 20.

With a low load of the high-pressure pump 20, i.e. a low delivery quantity and/or low fuel temperature, the pressure that the delivery pump 10 produces in the low-pressure region can be kept low, for which purpose the delivery pump 10 need only supply a small quantity of fuel, thus making it possible to minimize the load on the delivery pump 10, in particular on its electric drive unit 14, thus also minimizing the electrical energy required to power it. The delivery pump 10 with the electric drive unit 14 can therefore be designed for a lower average load, thus permitting its design to be simplified in comparison to a design with a constant delivery quantity or permitting an extended service life to be achieved in comparison to said design. Alternatively, it is also possible—without limiting the service life of the delivery pump 10—to permit an increased peak load with a large delivery quantity of the delivery pump 10 since this is only required for a short period of time.

The variable delivery quantity of the delivery pump 10 also reduces the load on the fuel filter 22 since it does not have the maximum delivery quantity of the delivery pump 10 flowing through it at all times, but rather only the delivery quantity of the delivery pump 10 that is actually required. The fuel filter 22 can therefore be dimensioned as smaller than in a conventional design for a constant delivery quantity of the delivery pump 10 or, with the same dimensioning, can achieve a longer service life. In addition, by increasing the fuel quantity that it delivers, the fuel pump 10 can at least partially compensate for a pressure drop occurring due to contamination of the fuel filter 22 as the flow passes through it.

FIG. 3 shows a the fuel injection device according to a second exemplary embodiment in which, by contrast with the first exemplary embodiment, the fuel metering device and possibly the overflow valve can be eliminated. The delivery pump 10 is equipped with the electric drive unit 14, which is triggered by the control unit 46. The fuel filter 22 is situated between the delivery pump 10 and the intake side of the high-pressure pump 20; the pressure sensor 56 that is connected to the control unit 46 is situated in the low-pressure region between the fuel filter 22 and the intake side of the high-pressure pump 20; the pressure that the pressure sensor 56 detects in the low-pressure region serves as a control variable for the control unit 46 in the triggering of the drive unit 14 of the delivery pump 10. It is also possible for the high-pressure region to contain the pressure sensor 48, which detects the pressure in the high-pressure region and is connected to the control unit 46. The high-pressure region can also contain the pressure relief valve or pressure control valve 43. A pressure control valve 60 is situated between the delivery pump 10 and the fuel filter 22 in order to prevent damage to the delivery pump 10 and/or the fuel filter 22 in the event of excessive pressure.

In the second exemplary embodiment of the fuel injection device, the fuel quantity delivered by the delivery pump 10 can be variably adjusted in order to variably adjust the quantity of fuel drawn in by the high-pressure pump 20 and delivered to the high-pressure region. The pressure that the delivery pump 10 produces in the low-pressure region can thus be kept essentially constant within predetermined limits. The control unit 46 triggers the drive unit 14 of the delivery pump 10 so that the delivery pump 10 supplies the intake side of the high-pressure pump 20 with a delivery quantity and the high-pressure pump in turn supplies the reservoir 42 with a fuel quantity that is sufficient to maintain a predetermined pressure in the reservoir 42. As the load on the internal combustion engine increases, the high-pressure pump 20 must deliver an increasing quantity of fuel into the reservoir 42 and the delivery pump 10 must deliver a correspondingly increasing quantity of fuel to the intake side of the high-pressure pump 20 in order to maintain the predetermined pressure in the low-pressure region. In this case, it is possible to eliminate the fuel metering device 50.

As an operating parameter of the engine and of the high-pressure pump 20, preferably their speeds can be taken into account by the control unit 46 and a pilot control of the pressure in the low-pressure region can take place so that as the speed increases, the delivery pump 10 delivers a larger quantity of fuel and a higher pressure is produced in the low-pressure region. Particularly in the idling mode of the internal combustion engine, the quantity of fuel delivered by the delivery pump 10 and therefore the pressure in the low-pressure region can be kept low, thus minimizing the required drive output for the delivery pump 10. As in the first exemplary embodiment, the fuel metering device 50 can be provided to adjust the delivery quantity of the high-pressure pump 20.

It is possible for at least part of the fuel quantity, which the delivery pump 10 delivers into the low-pressure region, to be supplied to the drive region 37 of the high-pressure pump 20 for lubrication and/or cooling. Preferably, the drive unit 14 of the delivery pump 10 is triggered by the control unit 46 so that the delivery pump 10 always delivers a minimum fuel quantity required to assure sufficient lubrication and/or cooling of the drive region 37 of the high-pressure pump 20.

In the fuel injection device according to the second exemplary embodiment, it is also possible to implement a monitoring of the low-pressure region for leaks since the presence of a leak can be ascertained based on the occurrence of a rapid pressure drop in the low-pressure region. With a changing, wear-induced leakage that occurs in the high-pressure pump 20 over the operation period of the high-pressure pump, only slow pressure drops occur in the low-pressure region, thus permitting clear differentiation here. If the control unit 46 detects a leak, it is possible, for example, to prevent further operation of the engine or to issue a warning to the vehicle driver.

The foregoing relates to the preferred exemplary embodiments of the invention, it being understood that other variants and embodiments thereof are possible within the spirit and scope of the invention, the latter being defined by the appended claims.

The invention claimed is:

1. A fuel injection device for an internal combustion engine, comprising a delivery pump, which is equipped with an electric drive unit and delivers fuel from a fuel tank into a low-pressure region and to an intake side of at least one high-pressure pump, the high-pressure pump delivering fuel into a high-pressure region in which at least one injector is provided, which injects the fuel into the engine, and an electric control unit for controlling the fuel injection, a pressure sensor contained in the low-pressure region that is connected to the control unit, wherein the control unit triggers the electric drive unit of the delivery pump in order to adjust a delivery quantity of the delivery pump, which quantity is variable as a function of at least one operating parameter of the engine and/or of the high-pressure pump, and in order to produce a predetermined pressure in the low-pressure region, at least a part of the fuel that the delivery pump delivers into the low-pressure region is conveyed through a drive region of the high-pressure pump, and wherein the fuel injection device includes a temperature sensor, which detects the fuel temperature and is connected to the electric control unit, and the control unit triggers the drive unit of the delivery pump so that with a high fuel temperature, the delivery pump produces a higher pressure in the low-pressure region than with a low fuel temperature.

2. The fuel injection device as recited in claim 1, wherein the control unit triggers the electric drive unit of the delivery pump to produce a variable pressure in the low-pressure region.

3. The fuel injection device as recited in claim 1, wherein the control unit triggers the electric drive unit of the delivery pump to adjust a variable delivery quantity of the high-pressure pump.

4. The fuel injection device as recited in claim 1, wherein a fuel filter is provided between the delivery pump and the intake side of the high-pressure pump while the pressure sensor is situated between the fuel filter and the intake side of the high-pressure pump.

5. The fuel injection device as recited in claim 1, wherein between the delivery pump and the intake side of the high-pressure pump, a fuel metering device is provided, which is able to vary the fuel supply to the intake side of the high-pressure pump.

6. The fuel injection device as recited in claim 4, wherein between the delivery pump and the intake side of the high-pressure pump, a fuel metering device is provided, which is able to vary the fuel supply to the intake side of the high-pressure pump.

7. The fuel injection device as recited in claim 1, wherein between the delivery pump and the intake side of the high-pressure pump, a fuel metering device is provided, which is able to vary the fuel supply to the intake side of the high-pressure pump.

8. The fuel injection device as recited in claim 5, wherein the electric control unit triggers the drive unit of the delivery pump so that with a high load and/or speed of the internal combustion engine, the delivery pump produces a higher pressure in the low-pressure region than with a low load and/or speed.

9. The fuel injection device as recited in claim 8, wherein the electric control unit triggers the drive unit of the delivery pump so that as the load and/or speed of the internal combustion engine increases, the delivery pump produces a continuously higher pressure in the low-pressure region.

10. The fuel injection device as recited in claim 5 wherein the fuel injection device includes a temperature sensor, which detects the fuel temperature and is connected to the electric control unit, and the control unit triggers the drive unit of the delivery pump so that with a high fuel temperature, the delivery pump produces a higher pressure in the low-pressure region than with a low fuel temperature.

11. The fuel injection device as recited in claim 6, wherein the fuel injection device includes a temperature sensor, which detects the fuel temperature and is connected to the electric control unit, and the control unit triggers the drive unit of the delivery pump so that with a high fuel temperature, the delivery pump produces a higher pressure in the low-pressure region than with a low fuel temperature.

12. The fuel injection device as recited in claim 3, wherein between the delivery pump and the intake side of the high-pressure pump, an overflow valve is provided, which controls a connection of the low-pressure region to a pressure-relief region.

13. The fuel injection device as recited in claim 7, wherein between the delivery pump and the intake side of the high-pressure pump, an overflow valve is provided, which controls a connection of the low-pressure region to a pressure-relief region.

14. The fuel injection device as recited in claim 8, wherein between the delivery pump and the intake side of the high-pressure pump, an overflow valve is provided, which controls a connection of the low-pressure region to a pressure-relief region.

15. The fuel injection device as recited in claim 12, wherein the overflow valve is embodied in the form of a pressure valve, which, with an increasing pressure in the low-pressure region, diverts an increasing quantity of fuel from the low-pressure region into the pressure-relief region.

16. The fuel injection device as recited in claim 1, wherein a connection between the delivery pump and the intake side of the high-pressure pump is routed through a drive region of the high-pressure pump upstream of the intake side of the high-pressure pump.

17. The fuel injection device as recited in claim 12, wherein the overflow valve is situated between the drive region and the intake side of the high-pressure pump so that the entire quantity of fuel delivered by the delivery pump flows through the drive region of the high-pressure pump.

18. The fuel injection device as recited in claim 15, wherein the overflow valve is situated between the drive region and the intake side of the high-pressure pump so that the entire quantity of fuel delivered by the delivery pump flows through the drive region of the high-pressure pump.

* * * * *